United States Patent [19]

Zoleski et al.

[11] 4,438,005

[45] Mar. 20, 1984

[54] MARINE DIESEL ENGINE LUBRICANT OF IMPROVED SPREADABILITY

[75] Inventors: Benjamin H. Zoleski, Beacon; Rodney L. Sung, Fishkill, both of N.Y.

[73] Assignee: Texaco Inc., White Plains, N.Y.

[21] Appl. No.: 450,606

[22] Filed: Dec. 17, 1982

Related U.S. Application Data

[63] Continuation-in-part of Ser. No. 224,414, Jan. 12, 1981, abandoned.

[51] Int. Cl.[3] ..... C10M 1/40

[52] U.S. Cl. ..... 252/33.4; 252/56 R

[58] Field of Search ..... 252/52 A, 56 R, 33.4

[56] References Cited

U.S. PATENT DOCUMENTS

| | | | |
|---|---|---|---|
| 2,493,483 | 1/1950 | Francis et al. | 252/56 R X |
| 2,944,021 | 7/1960 | Ulzheimer et al. | 252/56 R X |
| 2,944,022 | 7/1960 | Ulzheimer et al. | 252/56 R X |
| 3,791,971 | 2/1974 | Lowe | 252/52 A X |
| 3,793,351 | 2/1974 | McCoy | 252/56 R X |
| 3,933,662 | 1/1976 | Lowe | 252/52 A X |
| 3,945,930 | 3/1976 | Sugiyama et al. | 252/52 A X |

OTHER PUBLICATIONS

Yutaro et al., "Experimental Studies on the Abnormal Wear of Cylinder Liners and Piston Rings in a Marine Diesel Engine", Marine Engine Society, Tokyo, Japan, Tech. Pap., vol. Sess. No. 2-5, pp. 45-78, 1973.

Hori et al., "Spreadability of Marine Diesel Eng. Cyl. Oils . . . ", J. of Am. Soc. of Lub. Eng., vol. 33, 2, 83-90, 1977.

*Primary Examiner*—Andrew Metz

*Attorney, Agent, or Firm*—Robert A. Kulason; Robert Knox, Jr.

[57] ABSTRACT

The ability of marine diesel engine cylinder lubricants is improved by the incorporation therein of a spreadability improving amount of at least one polyoxyethylene ester of the formula:

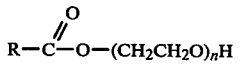

wherein n ranges from 18 to 22 and R is an alkyl group having 11 to 17 carbon atoms in the chain.

3 Claims, No Drawings

MARINE DIESEL ENGINE LUBRICANT OF IMPROVED SPREADABILITY

CROSS-REFERENCE TO CO-PENDING APPLICATION

This application is a continuation-in-part of coassigned U.S. application Ser. No. 224,414 filed Jan. 12, 1981 and now abandoned.

FIELD OF THE INVENTION

This invention relates to the novel use in the new environment of marine engine cylinder lubricants of certain polyoxyethylene esters which operate by a strictly physical action to improve the spreadability characteristics of such lubricants.

As is well-known, the main purpose of a lubricant is to provide a fluid film between moving metal surfaces to prevent metal-to-metal contact. Any portion of the metal surface not covered by the lubricant is a potential site for severe wear, scuffing and corrosion to take place. Premature wear, scuffing or corrosion will necessitate the replacement of parts sooner than normal, resulting in increased maintenance costs. Furthermore, any wear debris can cause damage in other parts of the engine.

In marine diesel engines, particularly the cross-headed type, which uses a separate oil system to lubricate the upper cylinder chamber (piston, rings and cylinder linings) were combustion occurs, the ability of the lubricant to cover all metal surfaces adequately and quickly is of paramount importance. The ability of a lubricant to cover a metal surface is known as its "spreadability" characteristic, which also measures its effectiveness in use.

The method used to lubricate the upper cylinder area of a cross-headed marine diesel engine consists of injecting the lubricant into the cylinder through a series of orifices (quills) that are located around the upper circumference of the cylinder. As the lubricant is injected it runs down and across the cylinder liner providing a film over the surface that should prevent metal-to-metal contact between the cylinder liner, piston rings and piston skirt as the piston travels up into the combustion chamber.

The problem addressed by the present invention is based on the observation that in many instances the lubricant does not cover the entire cylinder liner surface, leaving dry spots that are potential wear sites. Usually, the area directly under the quills is covered with an oil film but the area adjacent to the quills is dry because of the oil's poor spreadability.

One method of improving the spreadability of oil over the cylinder liner would be to redesign the injector/quill system. This approach would not only be impractical but would be economically prohibitive. Another means of improving spreadability would be to use a lower viscosity lubricant. However, since marine engines are designed to use SAE 50 grade cylinder oils for proper film strength, a lower viscosity product would not support the stresses occurring in this area of the engine and film breakage might be greater than desired, leaving additional areas of unprotected metal.

Another factor to consider is the increased use of high sulfur oils requiring the spreadability of lubricants to be such that they can be readily dispersed on diesel cylinder surfaces to neutralize acidic combustion products, thus preventing costly cylinder and piston ring corrosion and damage.

BACKGROUND OF THE INVENTION

Prior researchers do not appear to have realized that the spreadability of marine diesel engine cylinder lubricants could be improved by the additives of this invention. Thus, Belgian Patent No. 792,960 teaches lubricants for 2-stroke and rotary piston engines containing an ether, ester, complex ester, polyester or ether ester of polyalkylene glycols of the formula:

$$HO(RO)_nH$$

wherein R is a 2 to 5 carbon divalent radical and n ranges from 2 to 50.

Japanese application J5 No. 4160-401 describes a two-stroke engine oil containing a petroleum solvent, a base oil, a dispersant and a polyoxyethylene glycol monoalkyl ether surfactant. This oil is designed to reduce soot in the exhaust.

U.S. Pat. No. 3,933,662 disclosed a combination of an alkaline earth metal carbonate and a polyalkoxylated compound including alkyl poly(oxyethylene) fatty acid esters of the present type but where n ranges from 1 to 12 only these esters act by a chemical phenomenon to promote the neutralization of acid from an aqueous whose mixed with a lubricating oil as determined by $_nH$ measurements (Column 2, lines 30–33).

SUMMARY OF THE INVENTION

In accordance with the invention, there are provided marine diesel engine cylinder oils of improved spreadability owing to the incorporation therein of at least one polyoxyethylene ester of the formula:

$$R-\overset{\overset{\displaystyle O}{//}}{C}-O(CH_2CH_2O)_n$$

wherein R is an alkyl group having from 11 to 17 carbon atoms and n ranges from 18 to 22. The molecular weight of the compounds should be from 1000 to 1200. Preferred embodiments of the invention are those where R is 17, n is 20 and the molecular weight ranges from 1100 to 1170. R can be straight chained or branched, unsubstituted or can have its hydrogen atoms substituted by inert, non-interfering substituents.

The invention provides a process for improving the spreadability of a marine diesel engine cylinder oil by incorporating therein at least 0.5 weight percent thereof of at least one polyoxyethylene ester of the formula:

$$R-\overset{\overset{\displaystyle O}{//}}{C}-O(CH_2CH_2O)_n$$

wherein R and n are as above defined.

The invention additionally provides a process for lubricating the moving metal surfaces of a marine diesel engine cylinder by preventing their metal-to-metal contact with a film of the improved oils of the present invention.

DISCLOSURE

The preferred additives for use in this invention are sold commercially under the trade name BRIJ by ICI United States Inc., Wilmington, Del. 19897.

A particularly preferred additive is BRIJ 78, wherein n in the above formula is 20 and R is stearyl. Similarly preferred are additives where R is lauryl, cetyl or oleyl.

The hydrogen base oil conventionally employed to prepare the cylinder lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between about 100 and 1200, is normally employed for the lubricant composition. The most preferred lubricating viscosity for a cylinder lubricating oil composition is a viscosity ranging from about 68 to 108 SUS at 210° C. and is of SAE 50 grade. The hydrocarbon oil generally constitutes from about 80 to 90 weight percent of the total lubricating oil composition, with the preferred concentration range being from about 82 to about 88 weight percent.

The spreadability component of the cylinder lubricating oil composition of the invention is effective in a range from about 0.2 to 5 weight percent based on the total lubricating oil composition. In general, it is preferred to employ from about 0.5 to 2 weight percent of the glycol with the most preferred concentration ranging from about 0.75 to 1.5 weight percent.

The nature of the conventional alkaline detergents dispersant added to the oil to give it a TBN ranging from 50 to 100 is not critical. A mixture of 10 to 30 percent by weight basis weight of the oil of an overbased calcium sulfonate and a sulfurized overbased or normal calcium carbonate can be used.

The overbased calcium sulfonate used has a Total Base Number ranging from 300 to 450 on an active material or neat basis. This component is employed in the finished cylinder lubricating oil at a concentration ranging from 10 to 20 weight percent based on the weight of the lubricating oil composition. A preferred overbased calcium sulfonate has a TBN ranging from about 350 to 425, a preferred concentration of the sulfonate in the lubricating oil is from about 12 to 18 weight percent and a preferred TBN for the lubricating oil composition is from 60 to 80. Total Base Number (TBN) is a measure of alkalinity determined according to the test procedure outlined in ASTM D-664.

The overbased calcium sulfonates can be derived from sulfonic acids or particularly from petroleum sulfonic acids or alkylated benzene sulfonic acids. Useful sulfonic acids from which the overbased calcium sulfonates are prepared can have from about 12 to 200 carbon atoms per molecule. Examples of specific sulfonic acids include mahogany sulfonic acid, petrolatum sulfonic acids, aliphatic sulfonic acids and cycloaliphatic sulfonic acids. Particularly useful alkylated benzene sulfonic acids include polybutylbenzene sulfonic acid, polypropylbenzene sulfonic acid and copolymer propyl 1-butylbenzene sulfonic acids having molecular weights ranging from about 400 to 900.

The overbased calcium carbonates are produced by neutralizing the sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water. Methods for preparing overbased calcium sulfonates are disclosed in U.S. Pat. Nos. 3,779,920 and 4,131,551 and the disclosures in these references are incorporated herein by reference.

Spreadability Test Method

The compositions of this invention are tested by measuring the diameter (mm) of a drop of oil after a predetermined time that drop has been placed on a heated plate. As the drop diameter increases, the spreadability of the lubricant is improved. This procedure gives results which correlate with the performance of engine oils in the cylinder lubrication of cross-head type marine diesel engines.

The apparatus used in this method includes heating means such so that the temperature of a test panel can be controlled at 250±5° C. (unless otherwise specified). The panel coker specified in Federal Test Method Standard No. 791a, Method 3462 can be used. Also required are a microsyringe of 10±0.5 microliter capacity, needle exchangeable type, and calipers. The materials and reagents used are as follows: A test panel of gray iron castings conforming to JIS G 5501, Class FC-20, or ASTM A 48, Class No. 30; 50 by 50 by 5 mm. pierced with two holes, one of 2 mm. in diameter and 25 mm. in depth at the center of thin surface to insert a thermocouple, and another of 1 mm. in diameter of an edge for suspension in washing liquid; water abrasive papers (silicon carbide, 400, 600, and 800 grit); petroleum ether having a distillation range of 30°–80° C. or an equivalent refined naphtha; benzene and methyl alcohol.

In brief, the apparatus is prepared for use as follows: One surface of the test panel is polished by pushing and moving around it a 400 grit abrasive paper placed on a flat surface. It is subsequently polished the same way with 600 and 800 grit abrasive papers. Each polishing stage is continued until the disappearance of coarse scratches made in the preceding polishing stage. The test panel is washed after first removing dust using a gauze wet with petroleum ether. A wire is fastened to the hole at the edge of the test panel and same is suspended and dipped first into a beaker of hot benzene then in one of hot methyl alcohol, both boiling on a hot water bath, for one to two minutes, respectively. After removing the test panel, it is immediately dried with hot air.

The microsyringe is washed several times with petroleum either after detaching its needle. The plunger is then removed and the inside surface of the syringe is dried. It is washed twice with the sample to be tested, detaching the needle on intake and replacing it on discharging.

In performing the test, the test panel is placed on the heating block of the heating apparatus which is kept horizontal. Care must be exercised not to touch the surface of the test panel during the test. Next, the test sample is drawn slowly into the syringe to avoid the formation of an air bubble. The microsyringe is set vertically above the polished end washed surface of the test panel with a clearance of about 1 mm. In about 5 minutes, the test panel is heated to 250° C. While maintaining the temperature of the test panel at 250±5° C. (or at any other desired temperature), 10 microliters of sample are dropped on the panel. One minute after dropping, the diameter of the sample film is measured and recorded to the nearest 1 mm. If the sample film is elliptical, the longest diameter is measured; if the film juts out irregularly, the jutted out portion is not measured. When the sample film turns out to be too irregular, the determination is rejected and the procedure is repeated. Two separate determinations are conducted for each sample. If their individual values differ from more than 10 percent of their mean, two other determinations are carried out.

The values for two separate determinations are averaged to the nearest 1 mm. and the average is reported as the spreadability.

EXAMPLES

The invention is further illustrated in non-limiting fashion by the following examples.

The example involved blending at ambient temperature a polyalkoxylated phenoxy compound where n is 20, in an SAE 50 diesel engine cylinder lubricant. As determined by the test above described, this lubricant when unmodified has a spreadability value of 14.1 mm. and contains both paraffinic and naphthenic base stocks.

Considering Table I below, as shown by Blend 4, adding 2% of of a polyoxyethylene stearyl ester having 20 ethoxy groups to a blended oil increases the drop diameter to 28.8 mm. for an improvement of 160%. Little improvement in spreadability is realized below the 0.5% polyoxyethylene stearyl ester level as shown by Blend 1.

It should be noted that the additive has practically no effect on the viscosity of the oil and that the alkalinity as expressed by the total base number (TBN) of the oil is not changed by the additive at any of the concentrations tested so that no chemical effect can be attributed to the presence of the ester additive of this invention.

TABLE I

| | SAE 50 Control | 1 | 2 | 3 | 4 |
|---|---|---|---|---|---|
| Blended Oil | | | | | |
| Composition, Wt. % | | | | | |
| Base Oil 30 | 40.4 | — | — | — | — |
| Base Oil 50 | 30.2 | — | — | — | — |
| Alkaline Detergent[1] | 17.5 | — | — | — | — |
| Alkaline Detergent[2] | 8.8 | — | — | — | — |
| Alkaline Dispersant[3] | 3.1 | — | — | — | — |
| SAE 50 Control | — | 99.75 | 99.5 | 99 | 98 |
| Polyoxyethylene Stearyl ester | — | 0.25 | 0.5 | 1.0 | 2.0 |
| Tests | | | | | |
| Viscosity, SUS at 210° | 18.82 | 18.36 | 18.01 | 16.3 | 21.9 |
| TBN | 80 | 80 | 80 | 80 | 80 |
| Spreadability (mm.) | 10.8 | 10.9 | 11.5 | 24.9 | 28.8 |

[1]Calcium carbonate overbased (400 TBN) calcium sulfonate
[2]Sulfurized $CO_2$ blown, double neutralized normal calcium alkylphenolate
[3]Alkenylsuccinimides To demonstrate the unpredictable and unobvious character of the present invention and the criticality of having a specific number of ethoxy groups in the subject additives, compounds as disclosed in U.S. Pat. No. 3,933,662 having 4 to 10 epoxy groups respectively were tested as by the above described method. As shown in Table II, below, neither compound at the 2 weight percent level improved the spreadability performance of blends B and C in that their drop diameter was found to be 11.0 and 11.2 mm as opposed to a diameter of 10.8 mm for the unmodified base oil (A). Contrastingly, the same amount of an additive according to the invention containing 20 ethyoxy groups increased dramatically the spreadability of lubricant (D) from 10.8 mm to 28.8 mm.

TABLE II

| Blends No. | (A) | (B) | (C) | (D) |
|---|---|---|---|---|
| Composition, Wt. % | | | | |
| Nippon 30 Base Oil | 40.40 | | | |
| Nippon 50 Base Oil | 30.20 | | | |
| 1 | 3.10 | | | |
| 2 | 17.50 | | | |
| 3 | 8.50 | | | |
| Composition A | | 98 | 98 | 98 |
| Experimental compound with 4 ethoxylated groups[4] | | 2 | | |
| Experimental compound with 10 ethoxylated groups[5] | | | 2 | |
| Experimental compound with 20 ethoxylated groups[6] | | | | 2 |
| Spreadability, mm | 10.8 | 11.0 | 11.2 | 28.8 |

[1]Alkenylsuccinimides
[2]Calcium carbonate overbased (400 TBN) calcium sulfonate
[3]Sulfurized $CO^2$ blown, double neutralized normal calcium alkylphenolate.
[4]Polyoxyethylene (4) lauroyl ester.
[5]Polyoxyethylene (10) stearyl ester.
[6]Polyoxyethylene (20) stearyl ester.

In other tests the efficacy of the claimed compounds was established as follows as shown in Table III, below.

TABLE III

| Formula | Name | N | M.WT | Spreadability |
|---|---|---|---|---|
| $C_{11}-\overset{O}{\overset{\|}{C}}-O(CH_2CH_2O)_4H$ | Polyoxy ethylene lauryl ether | 4 | 368 | 11 |
| $C_{17}-\overset{O}{\overset{\|}{C}}-O(CH_2CH_2)_{10}H$ | Polyoxy ethylene stearyl ether | 10 | 724 | 12.4 |
| $C_{17}-\overset{O}{\overset{\|}{C}}-O(CH_2CH_2O)_{20}H$ | Polyoxy ethylene stearyl ether | 20 | 1164 | 31.8 |
| $C_{17}-\overset{O}{\overset{\|}{C}}-O(CH_2CH_2O)_{40}H$ | Polyoxy ethylene stearyl ether | 40 | 2044 | 19.2 |
| Base Oil (SAE 50) | No additives | — | — | 10.8 |

Found unsuitable were branched tridecanols polyethoxylated with 6 moles ethylene oxide. Only those compounds encompassed by the above set forth formula were found effective to increase spreadability of the diesel oils. All such compounds are fully equivalent to the exemplary compound for the purposes of this invention.

As shown in the examples, other additives are included in the lubricant of the invention. These additives can be antioxidants, dispersants, detergents, corrosion inhibitors and the like. The total amount of these additives will range up to 30 weight percent of the total lubricant.

We claim:

1. In a process for improving the spreadability of a diesel engine cylinder lubricant comprising an oil having an SAE viscosity of 50 and having a total base number ranging from about 50 to 100 provided by the presence therein of effective amounts of conventional alkaline detergent dispersants, the improvement consisting of blending with said lubricant a spreadability improving amount of at least one polyoxyethylene ester of the formula:

$$R-\overset{\overset{\displaystyle O}{//}}{C}-O-(CH_2CH_2O)_nH$$

wherein R is an alkyl group having from 11 to 17 carbon atoms and n is 18 to 22, said ester having a molecular weight ranging from 1000 to 1200.

2. In a process for lubricating the moving metal surfaces of a marine diesel engine cylinder which comprises causing a film of a diesel oil having a total base number ranging from about 50 to 100 provided by effective amounts of conventional alkaline detergents-dispersants, and an SAE viscosity of 50 to spread on said surfaces, the improvement consisting of incorporating in said diesel oil, 1.0 to 5.0 weight percent thereof of at least one polyethoxylated ester having a molecular weight of 1000 to 1200 spreadability of the formula:

$$R-\overset{\overset{\displaystyle O}{//}}{C}-O-(CH_2CH_2O)_nH$$

wherein R is an alkyl group having from 11 to 17 carbon atoms and n is 18 to 22.

3. A diesel engine lubricant comprising an oil having an SAE viscosity of 50 and a total base number ranging from about 50 to about 100 provided by the presence therein of effective amounts of conventional alkaline detergents-dispersants including overbased calcium sulfonates and carbonates, said lubricant having improved spreadability resulting from the incorporation therewith of a spreadability improving amount of a polyoxyethylene ester of the formula:

$$R-\overset{\overset{\displaystyle O}{||}}{C}-O-(CH_2CH_2O)_nH$$

wherein R is an alkyl group having 17 carbon atoms, n is 20 and said ester has a molecular weight in the range of 1100 to 1170.

* * * * *